US007958952B2

(12) United States Patent
Kusko et al.

(10) Patent No.: US 7,958,952 B2
(45) Date of Patent: Jun. 14, 2011

(54) PULSE RATE OF PENETRATION ENHANCEMENT DEVICE AND METHOD

(75) Inventors: David John Kusko, Houston, TX (US); Gabor Vecseri, Houston, TX (US); Daniel Maurice Lerner, Missouri City, TX (US)

(73) Assignee: Teledrill Inc., Katy, TX (US)

( * ) Notice: Subject to any disclaimer, the term of this patent is extended or adjusted under 35 U.S.C. 154(b) by 93 days.

(21) Appl. No.: 12/316,864

(22) Filed: Dec. 17, 2008

(65) Prior Publication Data

US 2009/0107723 A1 Apr. 30, 2009

Related U.S. Application Data

(63) Continuation-in-part of application No. 12/004,121, filed on Dec. 20, 2007, now Pat. No. 7,836,948.

(60) Provisional application No. 60/927,400, filed on May 3, 2007.

(51) Int. Cl.
*E21B 1/28* (2006.01)

(52) U.S. Cl. ..... 175/324; 175/317

(58) Field of Classification Search ..... 175/324, 175/317, 38, 234, 56, 393
See application file for complete search history.

(56) References Cited

U.S. PATENT DOCUMENTS

| | | | | |
|---|---|---|---|---|
| 3,958,217 | A | 5/1976 | Spinnler | |
| 4,817,739 | A * | 4/1989 | Jeter | 175/38 |
| 4,825,421 | A * | 4/1989 | Jeter | 367/83 |
| 4,901,290 | A | 2/1990 | Feld et al. | |
| 5,009,272 | A | 4/1991 | Walter | |
| 5,040,155 | A | 8/1991 | Feld | |
| 5,117,398 | A * | 5/1992 | Jeter | 367/85 |
| 5,190,114 | A | 3/1993 | Walter | |
| 5,508,975 | A | 4/1996 | Walter | |
| 5,626,016 | A | 5/1997 | Walter | |
| 6,053,261 | A | 4/2000 | Walter | |
| 6,082,473 | A | 7/2000 | Dickey | |
| 6,102,138 | A | 8/2000 | Fincher | |
| 6,237,701 | B1 | 5/2001 | Kolle et al. | |
| 6,279,670 | B1 | 8/2001 | Eddison et al. | |
| 6,318,482 | B1 * | 11/2001 | Fidtje | 175/318 |
| 6,338,390 | B1 | 1/2002 | Tibbetts | |
| 6,439,316 | B1 | 8/2002 | Penisson | |
| 6,508,317 | B2 | 1/2003 | Eddison et al. | |
| 6,588,518 | B2 | 7/2003 | Eddison | |
| 6,668,948 | B2 | 12/2003 | Buckman et al. | |
| 6,840,337 | B2 | 1/2005 | Terry et al. | |
| 6,898,150 | B2 * | 5/2005 | Hahn et al. | 367/85 |
| 6,975,244 | B2 * | 12/2005 | Hahn et al. | 340/855.7 |
| 6,997,272 | B2 | 2/2006 | Eppink | |
| 7,011,156 | B2 | 3/2006 | von Gynz-Rekowski | |
| 7,032,689 | B2 | 4/2006 | Goldman et al. | |
| 7,051,821 | B2 | 5/2006 | Samuel | |
| 7,100,708 | B2 | 9/2006 | Koederitz | |
| 7,145,834 | B1 * | 12/2006 | Jeter | 367/83 |
| 7,319,638 | B2 * | 1/2008 | Collette | 367/83 |
| 7,382,686 | B2 * | 6/2008 | Innes | 367/85 |
| 7,673,705 | B2 * | 3/2010 | Gearhart et al. | 175/40 |
| 2002/0157871 | A1 * | 10/2002 | Tulloch | 175/56 |

(Continued)

*Primary Examiner* — David J Bagnell
*Assistant Examiner* — Catherine Loikith
(74) *Attorney, Agent, or Firm* — Guerry L. Grune

(57) ABSTRACT

The system and device described relates to flow pulsing for use in down-hole drilling rate of penetration (ROP) enhancement and measurement while drilling (MWD) using a pulse drilling device (PDD) with a fast acting valve in conjunction with a pilot valve to produce high pressure, high amplitude, low duration pressure pulses.

20 Claims, 3 Drawing Sheets

U.S. PATENT DOCUMENTS

2003/0196836 A1 10/2003 Larsen et al.
2004/0108138 A1 6/2004 Cooper et al.
2005/0121235 A1 6/2005 Larsen et al.
2006/0076163 A1 4/2006 Terracina et al.

* cited by examiner

PULSE RATE OF PENETRATION ENHANCEMENT DEVICE AND METHOD

This application is a continuation-in-part and takes priority under 35 USC 120 from U.S. patent application Ser. No. 12/004,121, filed Dec. 20, 2007 now U.S. Pat. No. 7,836,948, and titled "Flow Hydraulic Amplification for a Pulsing, Fracturing, and Drilling (PFD) Device" and under 35 USC 119(e) from U.S. Provisional Application No. 60/927,400, filed May 3, 2007.

FIELD OF DISCLOSURE

This invention relates to flow pulsing methods and apparatus for use in primarily two applications, such as provided for but not limited to down-hole drilling rate of penetration (ROP) enhancement and MWD (measurement while drilling using an improved flow pulsing method used in downhole operations.

BACKGROUND OF DISCLOSURE

U.S. Pat. No. 7,180,826, U.S. Patent Publication US2008/0179093-A1 and U.S. Patent Publication No. 2008/0271923-A1 are herein fully incorporated by reference as describing a flow throttling device (FTD) for use in signaling applications using pressure pulses in a constrained, moving fluid column. The FTD uses hydraulic power from the moving drilling fluid to actuate the FTD against the moving fluid column. A fraction of the drilling fluid is utilized in a pilot valve to control the FTD, resulting in greatly reduced energy required to operate the FTD.

In a typical borehole, a drilling fluid is pumped from the surface to the drill bit through a passage formed in the drillstring. The drilling fluid flows back to the surface within the annular space between the drillstring and the formation. Most drilling operations use "mud" as the drilling fluid, due to its relatively low cost and availability, readily controlled viscosity, and other desirable characteristics. The mud also lubricates the drillstring and drill bit and seals cracks and crevices in the surrounding formation by forming a mud cake. This "mud cake" also keeps the formation from caving in on the drill string.

In classical rotary drilling, fluid or drilling mud is pumped downward through a hollow drill string to the base of the hole where the drilling mud cleans the drill bit and removes or clears away the cuttings from the drill bit cutting surface. The cuttings are then lifted and carried upwardly along the well bore to the surface. Generally, the drill bit will contain jets which provide fluid flows near the bit and serve to increase the effectiveness of cuttings removal and thus enhance the rate of penetration (ROP) of drilling.

Several ROP enhancement patents describe the use of vibrating devices to cause the drill string to vibrate longitudinally and enhance ROP. Vibrations are transmitted through the drill bit to the rock face thus increasing the drilling rate somewhat. These devices were subject to a number of problems as noted in U.S. Pat. No. 4,819,745 to Bruno Walter.

More recently the drilling rate has been increased by periodically interrupting the fluid flow to produce pressure pulses in the fluid and in so doing, generating a water-hammer effect which acts on the drill string to increase the penetration rate of the bit. Axially movable valve members have provided a significant improvement over the known art that includes rotary valve arrangements which have been less prone to jamming and seizing as the result of foreign matter in the drilling fluid. There is, however, a requirement for higher pump operating pressures which have not been implemented on a majority of drilling rigs due to cost and other factors.

Another method relies on the interruption of the flow by a member operated by the reduction of the pressure due to the Bernoulli effect in the area under the movable member. A flow-pulsing apparatus described in U.S. Pat. No. 5,190,114 to Bruno Walter, relies on this Bernoulli effect. This design is sufficient when the drilling fluid is water. However at greater depths when the heavier drilling fluid is used, the restricting member stabilizes and the effectiveness of the system is reduced. This design uses smaller amplitude pulses at a higher frequency to reduce the solid to solid impact forces of prior art, but does not generate large enough amplitude forces to work in harder lithologies. Additionally, this design cannot work with higher bit weights above 20,000 pounds weight on bit (WOB). Mechanical design changes allow pulse frequency and amplitude to be adjusted.

Additionally, it has been demonstrated that significant increases in drilling rate can be achieved by maintaining a borehole pressure that is less than the formation pressure (in a technique referred to as "underbalanced drilling"). Underbalanced drilling is achieved by reducing the amount of weighting material added to the drilling mud or by using gas or foam for the drilling fluid. The problem with underbalanced drilling is that the entire open section of the hole is subject to low pressure, which reduces borehole stability and increases the risk of a "gas kick." Gas kicks occur when the drill bit breaks into a region of higher gas pressure than the fluid column's mud weight pressure, causing gas bubbles to be entrained in the mud and rise toward the surface; the bubbles expand in volume as the pressure to which the bubbles are exposed drops when the bubbles rise in the borehole. If this gas kick goes unchecked through managed pressure drilling, a blowout may occur.

Another hydraulic system would provide a low-pressure region that is limited to the bottom of the borehole, with normal pressure controlling formation pressures higher up the hole. There have been attempts to achieve this condition using reverse flow bits; however, the bottom hole pressure reductions achieved with such bits have been relatively minor, i.e., less than 200 psi.

Another method of drilling uses interruption of the flow of the drilling fluid where the pressure of the drilling fluid forces the valve closed and/or opened. The pressures in the valve thus repetitively cycle it between an open and closed state. Drilling mud is fluid based and is thus substantially incompressible. Each time that the valve closes, the interruption of drilling fluid flow produces a "water hammer" pressure pulse upstream of the valve, due to the inertia of the flowing incompressible fluid against the closed valve. By continually cycling the valve between its open and closed positions, an axial force is applied to the drill bit by the repetitive water hammer pressure pulses. Since the frequency is relatively high (40 Hz or higher), the axial force is relatively small and it serves as more of an uncontrolled axial vibration on the bottom hole assembly (BRA) and does not substantially contribute to an improved drilling rate or efficiency.

It would be preferable to generate pulses in the drilling fluid having a pressure greater than 500 psi as a high amplitude, low frequency over the entire surface of the drill bits, since pressure pulses at these levels can generate forces that can fracture rock in the formation through which the drill bit is advancing and will greatly improve the efficiency of the drill bit by pushing the drill bit into the formation with substantially higher force than would be achieved using pump pressure and drill string weight alone. In addition, when the invention of the present disclosure creates a large amplitude, short duration pressure pulse by closing the pulsing fracturing device (PDD) in milliseconds, the application of the force at the bit is applied directly above the bit without the dampening effect of the drill string. Similarly, when the PDD opens, the stored fluid energy and pressure in the fluid column above the PDD is released in milliseconds, lifting the bit off the cutting face and generating a pressure shock wave through the jets clearing the cuttings away from the bit face, all of which, enhance the Rap. It is important to note that the quickness in which the PDD is closed and opened enhances the Rap since the axial forces are applied quickly. Additionally, Rap enhancement is optimized since the frequency and duration of the pulse is programmable on the surface. This allows the fluid column to reach a steady state flow pattern in between cycles.

RELEVANT ART

U.S. Pat. No. 7,100,708; to Koederitz, William I.; and assigned to Varco I/P, Inc., describes a method for controlling the placement of weight on a bit of a drilling assembly during the start of a drilling operation with the method comprising the steps of; establishing a set point for a parameter of interest related to the placement of weight on the bit; monitoring the parameter of interest and increasing actual weight on bit in a gradual manner until the set point is reached for the parameter of interest. The weight on bit is increased in a gradual manner by establishing a plurality of intermediate set points below the set point and sequentially moving the weight on bit along the intermediate set points.

U.S. Pat. No. 7,051,821; to Samuel, Robello; and assigned to Halliburton, describes a method of cleaning a hole in a subterranean formation comprising rotating a drillstring to drill a hole through the subterranean formation. The drillstring includes at least one cleaning device while rotating the drillstring and circulating fluid through the drillstring into the hole. In response to an increase in a hydrostatic pressure of the fluid in the drillstring, at least one adjustable vane is extended away from the cleaning device to clean accumulated cuttings from the drilled hole.

U.S. Pat. No. 7,032,689; to Goldman, et. al.; and assigned to Halliburton, describes an apparatus for predicting the performance of a drilling system comprising a first input device for receiving data representative of a geology characteristic of a formation per unit depth wherein the geology characteristic includes at least rock strength; a second input device for receiving data representative of specifications of proposed drilling equipment of the drilling system for use in drilling a well bore in the formation wherein the specifications include at least a specification of a drill bit. Additionally a processor is operatively connected to the first and second input devices for determining a predicted drilling mechanics in response to the specifications data of the proposed drilling equipment as a function of the geology characteristic data per unit depth according to a drilling mechanics model and outputting data representative of the predicted drilling mechanics. The predicted drilling mechanics includes at least one selected from the group consisting of bit wear, mechanical efficiency, and power and operating parameters. The processor further outputs control parameter data responsive to the predicted drilling mechanics data wherein the control parameter data is adaptable for use in a recommended controlling of a control parameter in drilling of the well bore with the drilling system. The control parameter includes at least one selected from the group consisting of weight-on-bit, rpm, pump flow rate, and hydraulics. Included is a third input device for receiving data representative of a real, time measurement parameter during the drilling of the well bore where the measurement parameter includes at least one selected from the group consisting of weight-on-bit, rpm, pump flow rate, and hydraulics. The processor is further operatively connected to the third input device and configured for history matching the measurement parameter data with a back calculated value of the measurement parameter data wherein the back calculated value of the measurement parameter data is a function of the drilling mechanics model and at least one control parameter and therein responsive to a prescribed deviation between the measurement parameter data and the back calculated value of the measurement parameter data. The processor is configured to perform at least one selected from the group consisting of; adjust the drilling mechanics model and modifying the control parameter data of a control parameter.

U.S. Pat. No. 7,011,156; to von Gynz-Rekowski, Gunther H H; and assigned to Ashmin, L C, describes a tool for delivering an impact comprising a cylindrical member having an internal bore, a first anvil and a first rotor disposed within the internal bore of the cylindrical member. The first rotor has an outer circumference with a first profile and contains an internal portion, a radial hammer face and a first sleeve disposed within the internal bore of the cylindrical member. The first sleeve has a top radial face containing a second profile that cooperates with the first profile. The first rotor has a position relative to the first sleeve wherein the first profile cooperates with the second profile so that the first radial hammer face contacts the first anvil and the first rotor has another position relative to the first sleeve wherein the first profile cooperates with the second profile so that the first radial hammer face is separated from the first anvil.

U.S. Pat. No. 6,997,272; to Eppink, Jay M.; and assigned to Halliburton, describes an assembly for drilling a deviated borehole from the surface using drilling fluids comprising a bottom hole assembly connected to a string of coiled tubing extending to the surface having a flowbore for the passage of drilling fluids. The bottom hole assembly includes a bit driven by a downhole motor powered by the drilling fluids, the bottom hole assembly and string forming an annulus with the borehole, a surface pump at the surface to pump the drilling fluids downhole, a first cross valve associated with the surface pump providing a first path directing drilling fluids down the flowbore and a second path directing drilling fluids down the annulus. A second cross valve adjacent the bottom hole assembly has an open position allowing flow through an opening between the flowbore and the annulus above the downhole motor and a closed position preventing flow through the opening. There is a first flow passageway directing drilling fluids through the first path, through the bottom hole assembly, and then up the annulus; and a second flow passageway directing drilling fluids through the second path, through the opening, and then up the flowbore.

U.S. Pat. No. 6,840,337; to Terry, et. al.; and assigned to Halliburton, describes an apparatus for removing cuttings in a deviated borehole using drilling fluids. The apparatus comprises a pipe string; a bottom hole assembly having a down hole motor and bit for drilling the borehole. The pipe string has one end attached to the bottom hole assembly; the pipe string being non-rotating during drilling and a means for raising at least a portion of the pipe string in the deviated borehole to remove cuttings from underneath the pipe string portion. The pipe string portion is disposed in the deviated borehole significantly uphole of the bottom hole assembly.

U.S. Pat. No. 6,668,948; to Buckman, et. al.; and assigned to Buckman Jet Drilling, Inc., describes a nozzle for jet drilling, comprising a body having an inlet end and an outlet end. The inlet end has a connector mechanism and the body has a longitudinal axis and forming an inlet chamber adjacent the inlet end. There is a disk for imparting swirling motion to the fluid inside the body with the disk disposed between the inlet chamber and a second chamber. The second chamber has an outlet and the disk has a plurality of orifices therethrough. At least one of the orifices is directed at a selected tangential angle with respect to the longitudinal axis for imparting a swirling motion to fluid in the second chamber. There is a front orifice forming the outlet of the second chamber with the front orifice having a selected diameter and an extension affixed to the outlet end of the body. The extension has an interior surface for confining fluid in a radial direction with the interior surface having a diameter greater than the diameter of the front orifice.

U.S. Pat. No. 6,588,518; to Eddison, Alan Martyn; and assigned to Andergauge Limited, describes a downhole drilling method comprising producing pressure pulses in drilling fluid using measurement-while-drilling (MWD) apparatus in a drill string having a drill bit and allowing the pressure pulses to act upon a pressure responsive device to create an impulse force on a portion of the drill string. The impulse force is utilized to provide a hammer drilling effect at the drill bit.

U.S. Pat. No. 6,508,317; to Eddison, et. al.; and assigned to Andergauge Limited, describes a flow pulsing apparatus for a drill string comprising a housing for location in a drill string above a drill bit. The housing defines a throughbore to permit passage of drilling fluid and a valve located in the bore, including first and second valve members, each defining a respective axial flow opening and which openings are aligned to collectively define an open axial drilling fluid flow port. The first member is rotatable about a longitudinal axis of the housing to vary the alignment of the openings between a first alignment in which the openings collectively define an open axial flow port of a first open area and a second alignment in which the openings collectively define an open axial flow port of a second open area greater than the first open area to, in use, provide a varying flow therethrough and variation of the drilling fluid pressure and drive means operatively associated with the valve for rotating the first member.

U.S. Pat. No. 6,439,316 to Penisson, Dennis; and assigned to Bilco Tools, Inc., describes a safety system for controlling operation of a power tong used to make up and break apart a threaded oilfield tubular connection. The power tong includes a tong frame having a frame open throat, a rotary ring rotatably supported on the tong frame and having a ring open throat. There is a door supported on the tong frame for opening to laterally move the power tong on and off the oilfield tubular connection and for closing over the frame open throat when the oilfield tubular connection is within the rotary ring, and a hydraulic motor supported on the tong frame for rotating the rotary ring. The safety system comprises a motor control valve operable to control flow of pressurized fluid from a hydraulic power source to the hydraulic motor, a switch supported on the tong frame for outputting a signal in response to the position of the door with respect to the tong frame, a valve operator for controlling operation of the motor control valve, a fluid pressure responsive member for automatically engaging and disengaging operation of the valve operator and thus the motor control valve. The fluid pressure responsive member is biased for disengaging operation of the motor control valve and a safety control line for interconnecting to the switch and the fluid pressure responsive member such that the switch engages operation of the valve operator by transmitting a closed door signal to the valve operator when the door is closed and the switch disengages operation of the valve operator by transmitting an open door signal to the valve operator when the door is open.

U.S. Pat. No. 6,338,390; to Tibbitts, Gordon A.; and assigned to Baker Hughes, Inc., describes an earth drilling device for variably contacting an earth formation comprising a near bit sub member configured for attachment to the downhole end of a drill string. There is a bit body attached to the near-bit sub member with the bit body having fixed cutting elements secured thereto and positioned to contact an earth formation. An apparatus associated with the near-bit sub member for produces a variable depth of cut by the fixed cutting elements into the earth formation while the bit body is rotated by the drill string. The apparatus is structured to provide axial movement of the bit body relative to the near-bit sub member to produce a variable depth of cut by the fixed cutting elements into the earth formation during drilling. The apparatus comprises a lower member attached to the bit body and an upper member spaced from the lower member and biased with respect thereto by a resilient member providing movement of the lower member relative to the upper member.

U.S. Pat. No. 6,279,670; to Eddison, et. al.; and assigned to Andergauge Limited, describes a downhole flow pulsing apparatus for providing a percussive effect comprising a housing for location in a string. The housing defines a throughbore to permit passage of fluid therethrough. A valve located in the bore defines a flow passage and includes a valve member. The valve member is movable varying the area of the flow passage to, in use, provide a varying fluid flow therethrough. A fluid actuated positive displacement motor operatively associated with the valve drives the valve member and a pressure responsive device which expands or retracts in response to the varying fluid pressure created by the varying fluid flow and the expansion or retraction providing a percussive effect.

U.S. Pat. No. 6,237,701; to Kolle, et. al.; and assigned to Tempress Technologies, Inc., describes an apparatus for generating a suction pressure pulse in a borehole in which a pressurized fluid is being circulated comprising a valve having an inlet port, an outlet port, and a drain port. The inlet port of the valve is adapted to couple to a conduit through which the pressurized fluid is conveyed down into the borehole. The valve, including a first member, that is actuated by the pressurized fluid to cycle between an open state and at least a partially closed state and the first member, while in the at least partially closed state, partially interrupts a flow of the pressurized fluid through the outlet port so that at least a portion of the flow of the pressurized fluid is redirected within the valve without completely interrupting the flow of the pressurized fluid into the inlet port. The pressurized fluid that was redirected within the valve when the first member was last in the at least partially closed state subsequently flows through the drain port and back up the borehole. A high velocity flow course is coupled in fluid communication with the outlet port of the valve. Having an inlet and an outlet, the suction pressure pulse is generated when the first member is in the at least partially closed state by substantially reducing the flow of the pressurized fluid through the high velocity flow course.

U.S. Pat. No. 6,102,138; to Pincher, Roger W.; and assigned to Baker Hughes, Inc., describes a downhole drilling assembly comprising a downhole motor supported on tubing with a bit driven by the motor, a thruster mounted to the tubing which extends in length for application of a desired weight on the bit and a compensating device to compensate for pressure change in the tubing caused by the bit or the motor to allow proper functioning of the thruster.

U.S. Pat. No. 6,082,473; to Dickey, Winton B.; and unassigned, describes a non-plugging nozzle comprising a body having a top, a bottom, and an axis. The body defines a central passageway extending therethrough from the top to the bottom in an axial direction so that the body has a side wall and a central passageway defining an inlet aperture at the top of the body, an exit aperture at the bottom of the body and a cylindrical portion. The body also defines a side passageway extending through the side wall intermediate the top and bottom of the body. The side passageway is in flow communication with the central passageway and intersecting the cylindrical portion. There is a side inlet orifice formed at the intersection of the side passageway and the central passageway with the side inlet orifice substantially squared to prevent plugging of the nozzle and an attachment mechanism wherein the body is removeably attached to a drill bit.

U.S. Pat. No. 6,053,261; to Walter, Bruno H.; and unassigned, describes an apparatus for effecting pulsations in a flow of liquid comprising an elongated hollow housing defining a primary flow passage adapted to carry a flow of liquid axially there along, an elongated conduit having an upstream end and a downstream end extending within the housing and defining a main flow passage interiorly of the conduit which communicates at its downstream end with said primary flow passage and a by-pass flow passage extending lengthwise of the conduit from the upstream end to the downstream end thereof. There is a nozzle located in the hollow housing adjacent to and spaced from the upstream end of the conduit adapted to discharge flow passing along the primary passage into the main flow passage defined by the conduit. The space between the nozzle and the upstream end provides communication between the main flow passage and the by-pass flow passage. An axially movable valve member located in the downstream end of the conduit and co-operating with a valve seat located downstream of the valve member interrupts the flow through the conduit. There is one or more passages downstream of the valve seat providing communication between the main flow passage and the by-pass passage in a region downstream of the valve seat. There is a spring for urging the valve member toward an open position in the upstream direction. The valve member is adapted to move to a closed position in response to flow along the valve member thus interrupting the flow through the conduit creating a water hammer pulse which travels upstream through the conduit and the nozzle and also through the space between the nozzle and the upstream end of the conduit. The pulse also travels downstream along the by-pass passage and through the further passage(s) to the region downstream of the valve member thus tending to momentarily equalize water hammer pressures on upstream and downstream sides of the valve member. The spring is adapted to move the valve member away from the seat under these equalized pressures whereupon flow within the conduit again commences thus again effecting the closure of the valve member whereupon the above recited sequence of events is repeated to produce a cyclical water hammer and flow pulsating effect. This is a relatively high frequency, high erosion hammering mechanism that is solid on solid and cannot be adjusted easily. Minor erosion of the mechanical components providing the venturi effect of the operation creates major deleterious deviations from the initial design.

U.S. Pat. No. 5,626,016; to Walter, Bruno H.; and unassigned, describes a method for shaking a structure relative to a member comprising the steps of providing a driving system and a deformable hollow element comprising:

i) a conduit having an inlet and an outlet;

ii) a source of pressurized fluid having an output pressure, connected to the inlet; 30 iii) a valve in the conduit;

iv) a valve actuator associated with the valve for repeatedly opening and closing the valve.

The hollow element comprises a deformable wall enclosing a fluid-filled cavity and first and second mounting points on the deformable wall. A change in a fluid pressure in the fluid filled cavity causes the second mounting point to move relative to the first mounting point; connecting the first mounting point to a structure to be vibrated relative to a member and connecting the second mounting point to the member and opening the valve and holding the valve open until the fluid flows through the conduit with a velocity sufficient to create a water hammer within the conduit. Suddenly closing the valve creates a water hammer within the conduit comprising a, pressure pulse having a pressure significantly greater than the output pressure;

allowing the water hammer pressure pulse to propagate into the cavity in the hollow element to increase the fluid pressure inside the cavity;

allowing a change in the fluid pressure in the cavity to cause the first mounting point to move relative to the second mounting point thereby moving the structure relative to the member repeating the above steps to cause the structure to shake relative to the member wherein the cavity is connected to the conduit by a branch conduit. The step of allowing the water hammer pressure pulse to propagate into the fluid filled cavity comprises allowing the water hammer pulse to propagate through the branch conduit into the cavity. The step of holding the valve open until the fluid flows through the conduit creates a velocity sufficient to create a water hammer within the conduit comprises reducing the fluid pressure in the cavity by allowing the fluid to flow through an aspirator in the conduit wherein the aspirator is connected to the branch conduit.

U.S. Pat. No. 5,508,975; to Walter, Bruno H.; and assigned to Industrial Sound Technologies, Inc., describes a liquid degassing apparatus and driving system comprising means for causing a first liquid to flow through a first conduit from an upstream end to a downstream end and a valve in the first conduit for selectively substantially blocking the flow of the first liquid. The valve has an open position wherein the flow is substantially unimpeded and a closed position wherein the flow is at least substantially blocked. There is an actuator for repeatedly opening the valve, keeping the valve open for a period sufficient to allow the first liquid to commence flowing, through the first conduit and the valve, with sufficient velocity to produce a water hammer within the first conduit when the valve closes. Closing the valve produces a continuous series of water hammer acoustic pulses within the first conduit. There is a chamber containing a second liquid coupled to the hydraulic driving system and a coupler in fluid communication with the driving system and the chamber with the coupler comprising a fluid-filled passage having a first end connected to the first conduit upstream from the valve and a second end connected to an interior region of the chamber and a stiff, resiliently deformable, impermeable, deflection cap blocking the fluid-filled passage.

U.S. Pat. No. 5,190,114; to Walter, Bruno H.; and assigned to Intech International, Inc., describes a liquid flow pulsing apparatus including a housing having means providing a passage for a flow of liquid and means for periodically restricting the flow through the passage to create pulsations in the flow and a cyclical water-hammer effect to vibrate the housing during us~. The means for periodically restricting the flow including a constriction means in the passage to accelerate the flow to a higher velocity and a first passage region through which the accelerated higher velocity liquid flows followed by a downstream passage region adapted to provide for a reduced liquid velocity and a movably mounted control means exposed in use to the liquid pressures associated with the first passage region and to the liquid pressures associated with the downstream passage region. It is adapted to move between a first generally full-flow position and a second flow restricting position in the first passage region by virtue of alternating differential liquid pressure forces associated with said first passage region and the downstream passage region and acting on the control means during use. The housing is arranged such that the movably mounted control means has one surface portion exposed to the liquid flow in the first passage region and a generally opposing surface position in communication with the liquid pressure existing in the downstream passage region such that the control means tends to be moved rapidly in a cyclical fashion between the first and second positions by virtue of the alternating differential pressure forces which arise from liquid flow induced pressure effects and water hammer effects acting on the control means during use.

U.S. Pat. No. 5,009,272; to Walter, Bruno H.; and assigned to Intech International, Inc., describes a flow pulsing apparatus including a housing having means providing a passage for a flow of fluid and means for periodically interrupting the flow through the passage to create a cyclical water-hammer effect to vibrate the housing and provide pulsations in the flow during use. The means for periodically interrupting the flow include a constriction means in the passage to accelerate the flow to a higher velocity and a first passage region through which the accelerated higher velocity fluid flows followed by an enlarged downstream passage region adapted to provide for a reduced fluid velocity and a control means having a pair of generally opposed faces. The control means is associated with the first passage region and being movable between a substantially open full-flow position and a substantially closed flow interrupting position. The control means, in use, has one of the faces at least partially exposed to the higher velocity fluid flow provided by the first passage region such that when the control means is in the open position the higher velocity fluid flow tends to reduce the pressure force acting on at least a portion of the one face and when the control means is in the closed position the flow interruption creates a fluid pressure force increase acting on at least a portion of the one face while the other of the faces of the control means is, in use, at least partially exposed to the fluid pressures existing in the downstream passage region. The control means thus tends to be moved rapidly, or to vibrate, between the substantially open and substantially closed positions under the influence of the alternating differential pressure forces acting on the opposed faces of the control means during use.

U.S. Patent Publication No. US20060076163A1; to Terracina, et. al.; and assigned to Smith International, Inc., describes a method for designing a drill bit comprising modeling a domain between a drill bit having a first design and a surrounding wellbore, defining a plurality of regions wherein one of the plurality of regions is disposed within each of a plurality of flow paths through which fluid travels through the domain, determining an allocation of flow among the plurality of flow paths through the domain and modifying the first design of the drill bit such that the allocation of flow is substantially uniform among the plurality of flow paths.

U.S. Patent Publication No. US20050121235A1; to Larsen, et. al.; and assigned to Smith International, Inc., describes a drill hit comprising a bit body with a bit central axis and defining a gage diameter. A first roller cone, attached to the bit body, has a cone shell, a journal axis, a gage curve, a first set of cutting elements that cut to the gage diameter and a second set of cutting elements that cut inside the gage diameter. There is a gage point at the intersection of the gage curve and at least one of the first set of cutting elements. There is at least a second roller cone attached to the bit body, having a cone shell, a journal axis, a third set of cutting elements that cut to the gage diameter and a fourth set of cutting elements that cut inside of the gage diameter. A first nozzle receptacle formed by the bit body and closer to the gage diameter than to the central axis with the first nozzle receptacle forming a first centroid and a first projected fluid path. The lateral angle for the first projected fluid path defined with respect to a first plane, the first plane being defined by the bit body central axis, and by a first line lying parallel to the bit body central axis and intersecting the first centroid. The first projected fluid path is disposed at an angle of at most a magnitude of six degrees to the first plane and a second nozzle receptacle formed by the bit body and closer to the gage diameter than to the central axis. The second nozzle receptacle forms a second centroid and a second projected fluid path. A lateral angle for the second projected fluid path is defined with respect to a second plane and also being defined by the bit body central axis. A second line lying parallel to the bit body central axis and intersecting the second centroid defines the second projected fluid path and is disposed at an angle of at least a magnitude of six degrees to the second plane wherein a radial angle for the second projected fluid path is defined with respect to at least two bounding lines. The second projected fluid path is directed between an outer gage boundary line and an inside boundary line with the outer gage boundary line being defined in a viewing plane perpendicular to the second projected fluid path. The outer gage boundary line is perpendicular to the projection of the journal axis for the first roller cone on the viewing plane and intersects the projected journal axis at a point of projection of an outer gage point on the viewing plane. The outer gage point is disposed at the intersection of the journal axis and a line perpendicular to the journal axis extending through the gage point. An inside boundary line is defined in the viewing plane where the inside boundary line is perpendicular to the projected journal axis and intersects the projected journal axis at a projection of the inside bounding point on the viewing plane. The inside bounding point is disposed along the journal axis at a distance equal to 20 percent of the gage diameter from the outer gage point toward the bit body central axis.

U.S. Patent Publication No. US20040108138A1; to Cooper, et. al.; and unassigned, describes a method for optimizing drilling fluid hydraulics when drilling a well bore when the drilling fluid supplied by a surface pump through a drill string to a drill bit comprises the step of adjusting the flow rate of a surface pump and a fluid pressure drop across the drill bit while drilling such that the drill bit drilling fluid hydraulics are optimized for a given drilling condition.

U.S. Patent Publication No. US20030196836A1; to Larsen, et. al.; and unassigned, describes a roller cone drill bit comprising a drill bit body defining a bit diameter, a longitudinal axis, and an internal fluid plenum for allowing fluid to pass through and having at least a first cone. Additionally a nozzle retention body for attaching to the drill bit body adjacent the first cone wherein the nozzle retention body has an interior channel that is in fluid communication with the internal fluid plenum and with a fluid outlet means for fluid discharge from the interior channel. The fluid is directed along a centerline and the first cone includes at least one cutting element with a cutting tip with the shortest distance between the cutting tip and the centerline being less than 3% of the bit diameter.

The device and method provided by the present disclosure allows for the use of a flow throttling device that moves from an initial position to an intermediate and final position in both the upward and downward direction corresponding to the direction of the fluid flow. The present invention avoids any direct use of springs, the use of which are described in the following patents which are also herewith fully incorporated by reference in U.S. Pat. No. 3,958,217, U.S. Pat. No. 4,901, 290, and U.S. Pat. No. 5,040,155, and U.S. Pat. Nos. 6,588, 518, 6,508,317, 6,279,670, and 6,053,261.

SUMMARY OF THE DISCLOSURE

Disclosed is a controllable (via computer, hydraulic, electric, etc.) downhole drilling system such that a pulsing drilling device (PDD) residing in a downhole drill string in a borehole in fluid environment provides a signal to close a pilot valve and a fast acting valve within the PDD by restricting a portion of the flow of fluid within the drill string, which allows for sudden increased pressure within the drill string just above the PDD. This sudden increased pressure over the first surface area of the top of the fast acting valve within the PDD results in a downward force onto the internal cross sectional area of the PDD. This rapid closing of the PDD valve generates a positive pressure pulse resulting in a sudden force applied directly above the bottom hole assembly (BRA) below the PDD that aids in penetrating the base of the wellbore formation. Field test results have shown that the PDD has at least doubled and in many cases more than quadrupled the rate of penetration (ROP) of the drill hit in comparison with conventional drilling technology.

In an additional embodiment the pressure increase is in the range of 500-2000 psi at the first surface of the PDD fast acting valve.

In another embodiment, the pressure increase at the first surface of the PDD fast acting valve acts over the entire cross sectional area of the PDD fast acting valve resulting in a large axial force applied to the drill bit thru the drill string.

In another embodiment, when the PDD fast acting valve closes it applies the force of the increased pressure directly behind the drill bit allowing for drilling deeper wells.

In yet another embodiment, closing the PDD valve results in axial drill string stretching which straightens the drill string, thereby enhancing the straightness of the well bore.

In another embodiment, opening the PDD valve results in relaxation of the drill string stretching, thus decreasing the weight on the drill bit and possibly lifting the drill bit from the base of the well bore.

In another embodiment, the combination of axial drill string stretching and the increased force on the drill bit allows for longer horizontal drilling because both force and movement are being applied directly behind the drill bit.

In another embodiment, the PDD valve actuates in 0.10 seconds or less. In another embodiment of the disclosure the apparatus for generating pulses includes a pilot, a pilot bellows, a PDD, a sliding pressure chamber, and a pulser guide pole. Upper and lower inner flow connecting channels provide for reversal of flow wherein the pilot seals an upper inner flow channel from the lower inner flow channel such that the PDD device and the pilot are capable of bi-directional axial movement along or within the guide pole.

A pulsing drilling device (PDD) comprising; a pilot valve, a pilot valve bellows, a sliding pressure chamber, a fast acting valve and a guide pole wherein said fast acting valve has upper and lower inner flow connecting channels providing for axial movement of said fast acting valve with in a fluid environment wherein the flow of fluid within said guide pole is restricted by said pilot valve thereby redirecting said fluid to said sliding pressure chamber thereby urging said fast acting valve to move on said guide pole thereby restricting flow of said fluid a drill string resulting in a sudden increased pressure of said fluid on one surface of said fast acting valve within said drill string, said increased pressure resulting in an axial force positive pulse through said PDD in said drill string applied directly above a bottom hole assembly (BHA) wherein said positive pulse urges a drill bit into a formation, and wherein said pilot valve receives a second signal to open said fast acting valve creating a negative pulse thereby releasing said increased pressure and said fluid into and through said drill bit thereby cleansing said drill bit of particles of said formation.

In another embodiment the pressure drop across the pilot is the only force per unit area that must be overcome to engage or disengage the pilot from the seated position and effect a pulse such that the pressure drop across a minimal cross-sectional area of the pilot ensures that initially only a small force is required to provide a pulse in the larger flow area of the PDD.

In another embodiment, the pulsing drilling device includes a nominal pressure of fluid across the pilot valve that is the only force (per unit area) that must be overcome to urge the pilot valve from the closed position and effect a pulse such that said force per unit area acting on the pilot valve quickly urges the fast acting valve and provides a pulse in the drill string.

In another embodiment opening the PDD valve provides for allowing the drilling fluid pressure in the drill string above the PDD to rapidly decrease, thereby rapidly decreasing the pressure on the drill bit. The drilling fluid pressure in the drill string below the PDD will consequently rapidly increase, increasing the flow velocity through the drill bit jets, and decreasing the weight on the drill bit.

In an additional embodiment the subsequent axial movement, which occurs when the PDD valve(s) opens and closes, also dislodges the drilling cuttings all along the drill string and in addition, reduction of friction is accomplished by same axial movement of the drill string. In another embodiment the drilling fluid pressure provided by the PDD greatly improves the efficiency of the drill bit by pushing the drill bit into the formation with substantially higher force than would be achieved using pump pressure and drill string weight alone.

In an additional embodiment the PDD creates a large amplitude, short duration pressure pulse by closing the pulsing fracturing device (PDD) in milliseconds, therefore applying the resulting force from the pressure pulse directly above the bit without the dampening effect of the drill string.

In yet another embodiment when the PDD opens, the stored fluid energy and pressure in the fluid column above the PDD is released in milliseconds, decreasing the weight on the cutting face and generating a pressure shock wave through the jets, cleaning the jets, clearing the cuttings away from the drill bit face and cleaning the drill bit face (reducing or eliminating "bit balling") which again enhances the ROP.

Another embodiment accomplished by the downhole drilling system of the present disclosure is the reduction of bit wear due to the washing of the bit face, clearing away of the cuttings, and not recrushing the cuttings during drilling (because the cuttings have been removed).

Another embodiment involving this downhole drilling system is that the action of the PDD provides a relatively smooth yet sudden increase in pressure which eliminates shock to the drill bit as the drill bit is continually in contact with the rock unlike conventional hammer drills. This protects the roller cone bearings and the polycrystalline diamond cutter (PDC) bits from excessive wear or damage that is often created by the conventional jarring that takes place using conventional hammer drill technology.

Another embodiment is the downhole drilling system may be used with rotary drilling and/or combined with bottom hole assemblies (BHA)'s utilizing downhole drilling motors, turbodrills, rotary steerable tools or any other drilling tools.

Another embodiment includes a PDD that is customizable and operates at any duty cycle, frequency, pulse width, pulse rise time, pulse fall time, and pulse amplitude (by adjusting the time that the valve is either opened or closed and by how much the valve is opened or closed)

Another embodiment includes a PDD for well bores formed in multiple directions.

Another embodiment is that when the PDD is in operation it is removing debris from the jets.

In another embodiment, when the PDD valve closes and increases the force on the drill bit, the additional force on the drill bit pushes the drill bit into the rock face and momentarily stalls the drill bit, thereby storing rotational energy in the drill string. This extra energy during pressure release when the PDD valve opens unleashes stored rotational energy which increases torque and assists the drill bit in effectively removing freshly fractured rock. In addition, reduction of friction is accomplished by the same axial movement of the drill string.

In another embodiment the sensors can also be measurement while drilling (MWD) devices.

In another embodiment the downhole rate of penetration is optimized using the PDD device and allows for enabling an operator to make intelligent decisions uphole using uphole equipment including manual tools, computers and computer software to provide proper and optimal settings for weight on bit, rotations per minute of the bit, and the flow rates of the fluid and any other adjustable parameters.

Another embodiment is that the downhole rate of penetration is optimized using the PDD device and allows for enabling an operator to make intelligent decisions using data sent from downhole sensors to provide proper and optimal settings for weight on bit, rotations per minute of the bit and the flow rates of the fluid and any other adjustable parameters.

DETAILED DESCRIPTION OF THE DRAWINGS

Figure 1:
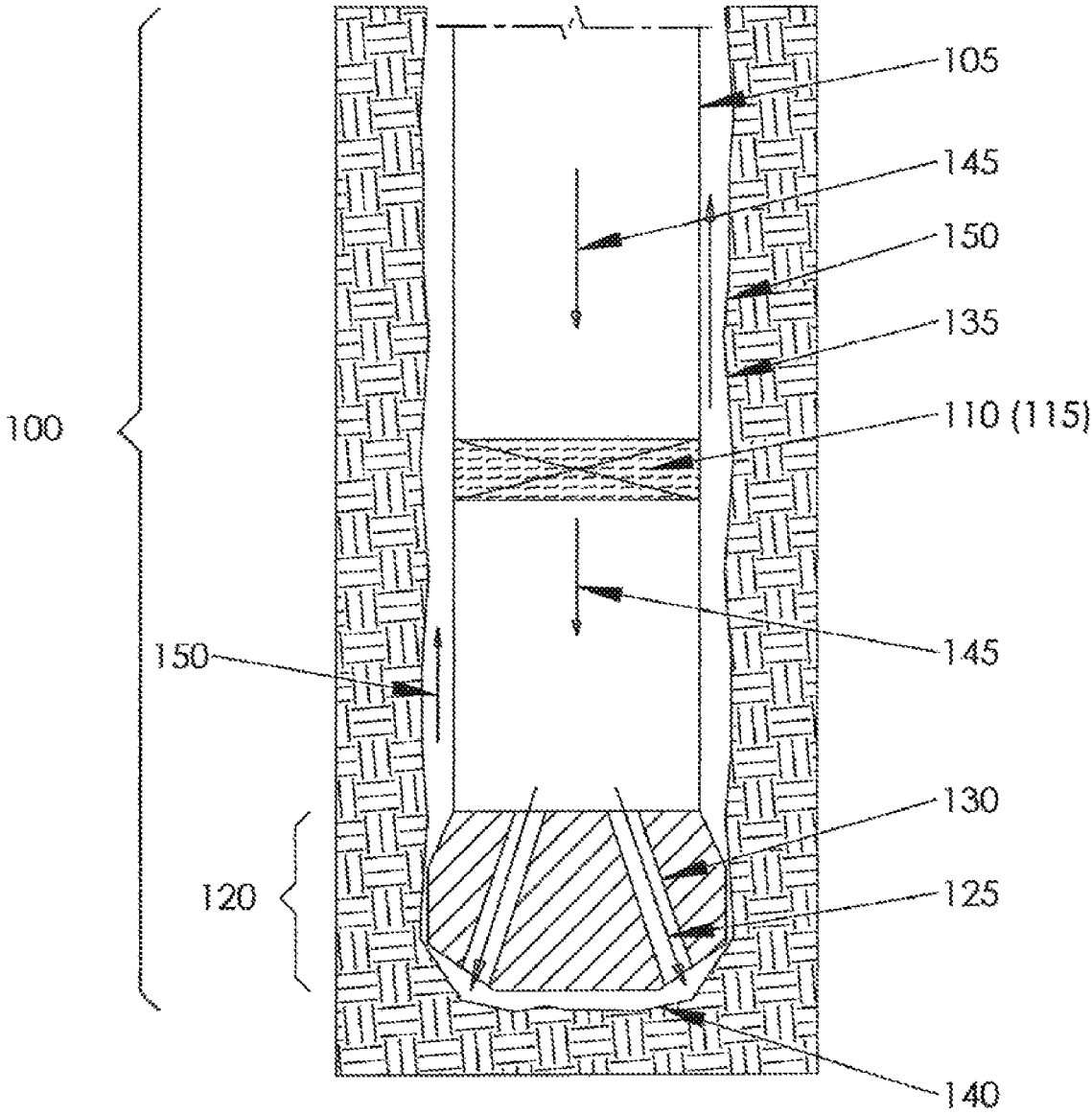
FIG. 1 shows a cross section schematic of drilling string.
Figure 2:
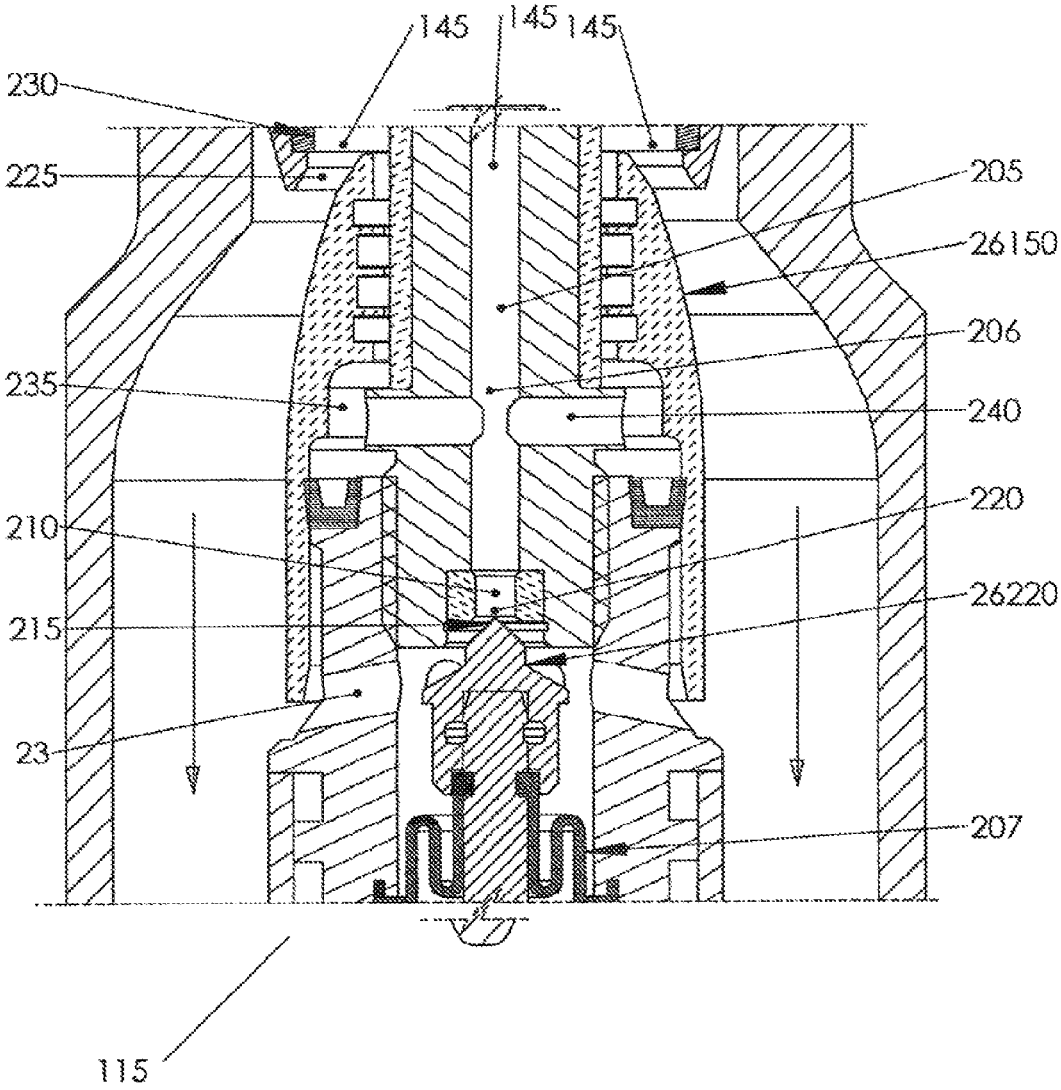
FIG. 2 shows a sectional view of a pulsing, fracturing device (PDD) in a drill string with the fast acting valve assembly.

FIG. 1 shows a cross sectional schematic of the components in the disclosed drill string [100] having a tube [105] containing a pulsing, fracturing device (PDD) [110] with a fast acting valve [115] (as shown and described in FIG. 2). Further shown is a drill head [120] attached to the bottom of the tube [105] having one or more drill bites) [125] and one or more jet(s) [130] at the bottom of the borehole [135] or rock face [140].

While drilling, there is a flow of fluid [145] that is pumped from above the borehole [135] (shown with a downward facing arrow) moving through the tube [105] in a downward direction, with fluid [145] passing through the PDD [110] when the fast acting valve [115] is open, and continuing through the drill head [120] and jets [130] and against the bottom of the borehole [135] or rock face [140]. The drilling direction may be vertical, horizontal or any combination of angles and/or inclines. The fluid [145] is then directed to flow outside the tube [105] upward through the annulus [150] and out through the borehole [135]. The fluid [145] is mainly comprised of water and therefore resists compression.

Operationally, the drill head [120] and drill bits [125] move against the rock face [140] which provides for wear of the surface and chipping away at the rock face [140]. This occurs in order to allow the depth of the borehole [135] to progress and lengthens the drill string [100]. The chips and cuttings from the rock face [140] are then transported in the flow of the fluid [145] up through the annulus [150] where they are subsequently removed from the fluid [145]. The rate at which the rock face [140] is worn away is known as the rate of penetration (ROP).

In order to increase (speed up) the ROP, the PDD [110] within the tube [105] closes the fast acting valve [115] which blocks the flow of fluid [145] moving downward in the tube [105] above the fast acting valve [115]. The nominal pressure of the fluid [145] increases above the fast acting valve [115], increasing the potential energy above the fast acting valve [115], which straightens the drill string [100] within the borehole [135] and forces the drill head [120], drill bits [125] and jets [130] into the rock face [140].

Below the fast acting valve [115], the pressure decreases (further described and shown in FIG. 3) as the remaining fluid [145] flows from the drilling head [120] through the jets [130] into the annulus [150]. At a desired time or desired pressure, fast acting valve [115] is opened and fluid [145] is released from the high pressure region above the fast acting valve [115] to the low pressure region below the fast acting valve [115]. The fast acting valve [115] opens within milliseconds causing a hydraulic pulse in the fluid [145] that is at a higher pressure than the nominal pressure of the fluid [145]. The fluid passes through the jets [130] thereby fracturing the rock face [140] at the bottom of the borehole [135]. The pressure differential above and below the fast acting valve [115] and the sudden release of the fluid [145] creates and executes a "water hammer effect". Briefly, the energy added into the constrained moving fluid [145] is aided by converting kinetic energy to potential energy as the fluid [145] is forced to decelerate by rapid closing of the fast acting valve [115]. The potential energy is captured in the form of pressure being stored within the drilling fluid [145]—where the fluid [145] is acting in a similar manner to a spring that is being coiled. Because of the huge mass of constrained fluid [145], in potentially thousands of feet of drill string [100], there is more than sufficient potential energy build-up in the drill string [100] to produce thousands of pounds of pressure above the fast acting valve [115].

Earlier teachings differ from the present disclosure in that the fast acting valve [115] closes and opens in milliseconds. This is a unique feature that allows fluid [145] at high pressure to impact the drill head [120], drill bits [125] and jets [130]. The rate, duty cycle, amplitude, and frequency of the actuation of the fast acting valve [115] is computer controllable and may be additionally controlled by varying mechanical parameters of the PDD [100] itself.

Fracturing while drilling is very effective since the formations in the borehole [135] are open and porous and there has not been time to build a mud cake (not shown) on the borehole [135] wall which typically is used to seal the borehole [135]. Fracturing may be performed with a proppant added to the column of fluid [145] to keep the pores in the borehole [135] open.

FIG. 2 is a sectional view of the pulsing, fracturing device (PDD) fast acting valve [115] components. Shown are a guide pole channel [205], the guide pole [206] and orifice chamber [210] in the proximity of the pilot seat [215] and pilot seat orifice [220]. The flow of fluid [145] and pressure in the guide pole channel [205] are significantly lower than the nominal pressure of the fluid [145] flowing through the actuator orifice [230]. When the pilot valve [26220] is in contact with the pilot seat [215] fluid [145] stops flowing through the guide pole channel [205] essentially backing up to flow through the connecting channel(s) [240] to the internal chamber [235] which fills with fluid [145] and moves the actuator [26150] toward the actuator seat [225] such that the flow of fluid [145] is restricted through the actuator orifice [230] and downstream to the drill bits [125] (not shown). When the actuator [26150] moves to restrict the flow of fluid [145] the pressure builds above the actuator [26150] in the tube [105] (ref. FIG. 1) converting the nominal kinetic energy of the fluid [145] (ref. FIG. 1) into high potential energy. FIG. 2 also shows the bellows [207] and the connecting channels [23] as described above.

Figure 3:
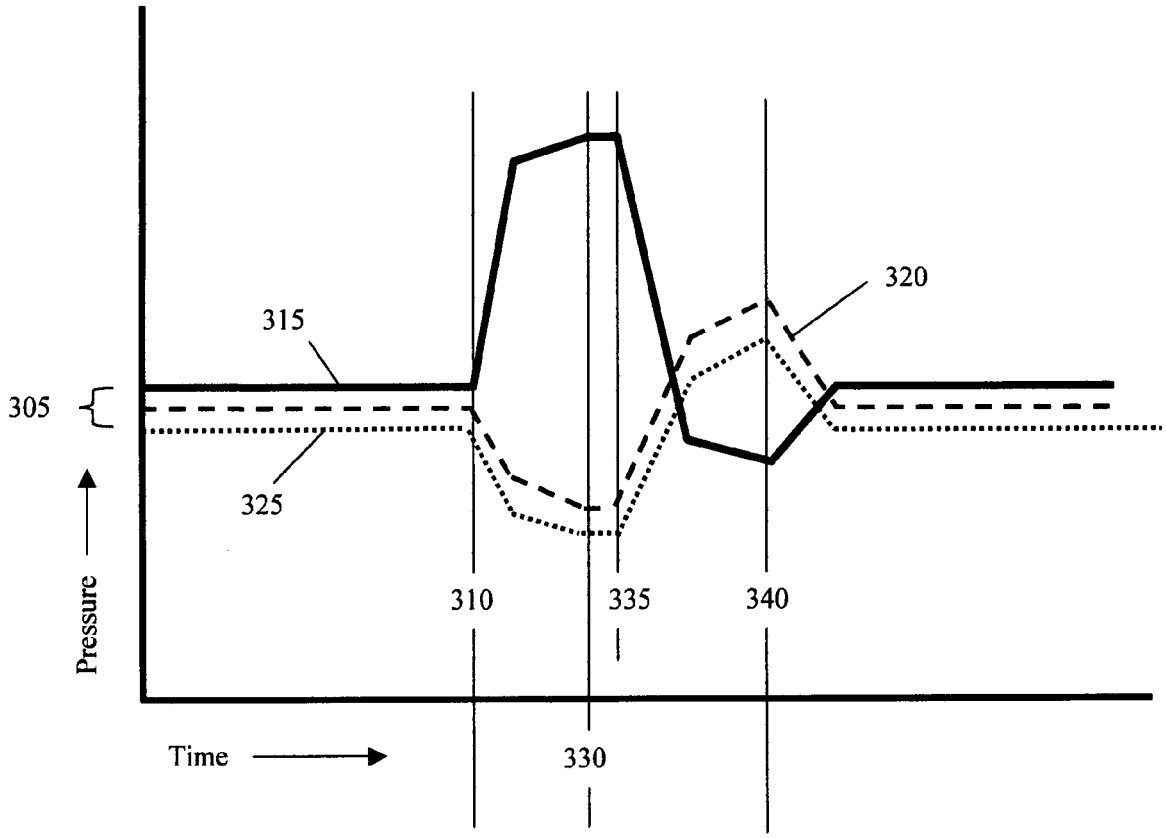
FIG. 3 is a pressure verses time graph above and below the fast acting valve.

Below the actuator [26150] the fluid [145] continues through the jets [130] (ref. FIG. 1) at less than nominal pressure (ref. FIG. 3) and into the annulus [150] (ref FIG. 1).

Inversely, when the pilot valve [26220] is de-actuated and not contacting the pilot seat [215] the flow through the guide pole channel [205] is restored thereby draining the inner chamber [235] and channels [240] such that the actuator [26150] withdraws from the actuator seat [225] opening the actuator orifice [230]. The high potential energy created in the fluid [145] as high pressure is suddenly released through the actuator orifice [230] flowing through the tube [105] (ref. FIG. 1) and through the jets [130] (ref. FIG. 1).

The actuation and de-actuation of the actuator [26150] occurs in milliseconds due to the low pressure required to actuate the pilot valve [26220] which in turn operates the actuator [26150] in the higher pressure fluid [145] environment. The actuation of the pilot valve [26220] and actuator [26150] may be customized for any situation such that changes in frequency, amplitude, duration, actuator [26150] actuation time and duty cycle including a periodic pulses may be generated either by computer input and/or changes to mechanical components of the fast acting valve [115].

FIG. 3 is a plot depicting time and pressure data obtained from the device of the present disclosure which illustrates the relation to closing and opening the fast acting valve [115] for various pressures above and below the fast acting valve [115]. Nominal drilling fluid pressure [305] increases with the valve closed [310] above the fast acting valve [115] creating a greater upper drill string pressure [315]. The flow of fluid [145] is interrupted below the fast acting valve [115] causing the pressure below the valve [320] and the jet pressure [325] to decrease in comparison with nominal drilling fluid pressure [305]. The pressure below the valve [320] does not drop as rapidly as the upper drill string pressure [315] increases. There is more elasticity in the fluid [145] because of air trapped within the fluid [145]. The drop in pressure allows the drill bits [125] to push against the rock face [140] with considerably large force. The desired peak pressure [330] is attained urging the valve open [335] such that the fluid [145] flows past the fast acting valve [115] decreasing the greater upper drill string pressure [315] toward nominal fluid pressure [305]. The pressure below the valve [320] is increasing and the jet pressure [325] becomes greater than the nominal fluid pressure [305] where the pressure pulse moves past the jets [130]. This pulse allows for cleaning the drill bits [125] enhancing drilling rate, clearing bit balling so the drill bits [125] can cut more effectively, and fracturing of the rock face [140]. The pressure of the fluid [145] reaches an inverse maximum pressure [340] post pulse and normalizes at the nominal fluid pressure [305]. The nominal fluid pressure [305] is relatively equal above the fast acting valve [115], below the fast acting valve [115] and through the jets [130] although it is shown illustratively as separate pressures in FIG. 3.

The fast acting valve [115] closing and opening sequence occurs between 100 and 600 milliseconds and is customizable for any duty cycle from 1-100 percent and is particularly effective below 25 percent duty cycle. Additionally, the fast acting valve [115] actuation may be computer generated and produced at desired rates, time patterns, frequencies, duty cycles or pseudo-random patterns to distinguish between pressure pulses and natural formation frequencies and may be determined by attaining a desired greater upper drill string pressure [315].

What is claimed is:

1. A controllable downhole drilling system comprising; a pulsing drilling device (PDD) residing in a downhole drill string in a borehole in a fluid environment wherein said PDD comprises; a pilot valve and a fast acting pilot valve with a pilot valve bellows, in contact with a pilot seat such that fluid in said fluid environment stops flowing through a guide pole channel forcing said fluid to back up and subsequently flow through connecting channels and into an internal chamber which fills with fluid and moves an actuator toward an actuator seat such that the flow of fluid is restricted through an actuator orifice as said fluid is directed downstream to drill bits such that when said actuator moves to restrict the flow of fluid the pressure above said actuator builds up within a well bore casing converting the nominal kinetic energy of the fluid into high potential energy and inversely, when said pilot valve is deactivated and not contacting said pilot seat the flow of said fluid through said guide pole channel is restored thereby draining said internal chamber and said connecting channels such that said actuator withdraws from said actuator seat, allowing for opening of said actuator orifice such that said high potential energy created in the fluid as high pressure is suddenly released through said actuator orifice flowing through said well bore casing and through jets situated below said actuator allowing said fluid to flow into an annulus between said well bore casing and a formation within which said well bore resides resulting in actuation and deactivation of said actuator within milliseconds and wherein said PDD provides a first signal to close said pilot valve within said fluid environment thereby restricting a portion of the flow of said fluid within said drill string allowing for a sudden increase in pressure of said fluid on one surface of said fast acting valve within said drill string, said increased pressure resulting in a first axial unidirectional pulse and associated force through said PDD in said drill string applied directly above a bottom hole assembly (BHA), wherein said pulse forces a drill bit into a formation, and wherein said pilot valve receives a second signal to open said fast acting valve, creating a second unidirectional pulse in a direction opposite to said first axial unidirectional pulse, thereby releasing said increase in pressure within said fluid surrounding said drill bit, allowing for cleansing of said drill bit from particles formed during drilling into said formation.

2. The controllable downhole drilling system of claim 1, wherein said PDD is adjustable by using independently controlled hydraulic, electrical, mechanical device or a combination of hydraulic, electrical and/or mechanical devices.

3. The controllable downhole drilling system of claim 1, wherein said increase in pressure is in the range of 500 to 2000 psi at the first surface of said fast acting valve.

4. The controllable downhole drilling system of claim 1, wherein said fast acting valve actuates in 0.10 seconds or less, creating said first axial unidirectional pulse of sufficient amplitude and duration directly above said drill bit in order to provide a dampening effect during operation of said system utilizing said drill string.

5. The controllable downhole drilling system of claim 1, wherein said increase in pressure at said first surface of said fast acting valve acts over the entire cross sectional area of said fast acting valve resulting in said unidirectional axial pulse with a force greater than the force exerted by said drill string and said pump pressure within said fluid environment wherein said force exerted by said drill string and said pump pressure is applied directly to said drill bit.

6. The controllable downhole drilling system of claim 1, wherein closing said fast acting valve applies the force of said increase in pressure directly behind said drill bit forcing said drill bit into said formation, and momentarily stalling said drill bit, thereby providing a rotational torque to said drill string, such that when said fast acting valve is opened, said increase in pressure is subsequently decreased, allowing for drill string torque to accumulate within said drill string, wherein said accumulated torque is applied to said drill bit, further increasing the rate of penetration resulting in drilling deeper wells.

7. The controllable downhole drilling system of claim 1, wherein closing said fast acting valve results in axial drill string stretching thereby straightening the drill string and enhancing the straightness of the wellbore.

8. The controllable downhole drilling system of claim 7, wherein combining said axial drill string stretching and said force on said drill bit allows for longer drilling in either horizontal or multiple directions, and wherein the combination of said axial drill string stretching and said force are both applied directly behind said drill bit.

9. The controllable downhole drilling system of claim 1, wherein opening said fast acting valve provides for allowing said increase in pressure within said drill string on said first surface of said fast acting valve to rapidly decrease, providing a sudden flow of said fluid below said fast acting valve wherein said sudden flow decreases said force on said drill bit allowing self-cleansing of said drill bit and removing of debris from said formation, thereby further enhancing the rate of penetration.

10. The controllable downhole drilling system of claim 1, wherein actuating said fast acting valve provides a smooth transition during the sudden pressure increase, thereby eliminating shock to said drill bit such that said drill bit is continually in contact with said formation, thereby protecting bearings of said drill bit from excessive wear or damage.

11. The controllable downhole drilling system of claim 10, wherein wear of said drill bit is reduced due to self-cleansing of said drill bit such that said fluid clears away cuttings of said formation, eliminating any need for re-crushing said cuttings during drilling.

12. The controllable downhole drilling system of claim 1, wherein said downhole drilling system is used with rotary drilling and/or combined with bottom hole assemblies (BHA) 's utilizing downhole drilling motors, turbo-drills, rotary steerable tools or other conventional drilling tools.

13. The controllable downhole drilling system of claim 1, wherein said system is customizable so that said system operates at any duty cycle, frequency, pulse width, pulse rise time, pulse fall time, and/or pulse amplitude.

14. The controllable downhole drilling system of claim 1, wherein sensors are used in any navigable location to sense the need to control any duty cycle, frequency, pulse width, pulse rise time, pulse fall time, and/or pulse amplitude.

15. The controllable downhole drilling system of claim 14, wherein said sensors can also be measurement while drilling (MWD) devices.

16. The controllable downhole drilling system of claim 1, wherein the downhole rate of penetration is optimized using said PDD device and allows for enabling an operator to make intelligent decisions uphole using uphole equipment including manual tools, computers and computer software to provide proper and optimal settings for weight on bit, rotations per minute of said bit, and the flow rates of said fluid and any other adjustable parameters.

17. The controllable downhole drilling system of claim 1, wherein the downhole rate of penetration is optimized using said PDD device and allows for enabling an operator to make intelligent decisions using data sent from downhole sensors to provide proper and optimal settings for weight on bit, rotations per minute of said bit and the flow rates of said fluid and any other adjustable parameters.

18. A controllable pulsing drilling device (PDD) comprising; a pilot valve, a pilot valve bellows, a sliding pressure chamber, a fast acting valve and a guide pole wherein said fast acting valve pilot valve with a pilot valve bellows, in contact with a pilot seat such that fluid in said fluid environment stops flowing through a guide pole channel forcing said fluid to back up and subsequently flow through connecting channels and into an internal chamber which fills with fluid and moves an actuator toward an actuator seat such that the flow of fluid is restricted through an actuator orifice as said fluid is directed downstream to drill bits such that when said actuator moves to restrict the flow of fluid the pressure above said actuator builds up within a well bore casing converting the nominal kinetic energy of the fluid into high potential energy and inversely, when said pilot valve is deactuated and not contacting said pilot seat the flow of said fluid through said guide pole channel is restored thereby draining said internal chamber and said connecting channels such that said actuator withdraws from said actuator seat, allowing for opening of said actuator orifice such that said high potential energy created in the fluid as high pressure is suddenly released through said actuator orifice flowing through said well bore casing and through jets situated below said actuator allowing said fluid to flow into an annulus between said well bore casing and a formation within which said well bore resides resulting in actuation and deactivation of said actuator within milliseconds and said pilot valve has upper and lower inner flow connecting channels providing for axial movement of said fast acting valve within a fluid environment and wherein the flow of fluid within said environment is restricted by said pilot valve thereby redirecting fluid into said sliding pressure chamber thereby urging said fast acting valve to move on said guide pole and restricting flow of said fluid within a drill string resulting in a sudden increase in pressure of said fluid on one surface of said fast acting valve within said drill string wherein said increase in pressure results in a first unidirectional axial force creating a pulse through said PDD within said drill string that is applied directly above a bottom hole assembly (BHA).

19. The controllable PDD of claim 18, wherein said pulse urges a drill bit into a formation, and wherein said pilot valve receives a second signal to open said fast acting valve, thereby creating a second unidirectional axial force creating a pulse in the opposite direction as said first unidirectional pulse when said increase in pressure is released forcing said fluid through said drill bit and allowing for cleansing said drill bit from particles formed during drilling said formation.

20. The controllable PDD of claim 18, wherein the nominal pressure of said fluid environment across said pilot valve is the only force per unit area that must be overcome to urge said pilot valve from the closed position to an open position and cause said pulse such that said force per unit area applied to said pilot valve quickly urges said fast acting valve thereby providing a pulse in said drill string.

* * * * *